United States Patent [19]

Sutliff

[11] 4,263,794

[45] Apr. 28, 1981

[54] LATCH LOCK MECHANISM FOR ANSATE LUGGAGE

[76] Inventor: David G. Sutliff, Hudson Dr. & Rte. 39, New Fairfield, Conn. 06810

[21] Appl. No.: 3,255

[22] Filed: Jan. 15, 1979

[51] Int. Cl.[3] ..... E05B 65/52

[52] U.S. Cl. ..... 70/70; 70/207; 70/312

[58] Field of Search ..... 70/63, 64, 67, 69, 70, 70/71, 207, 209, 312; 16/110 R; 190/39, 55 R, 56, 57

[56] References Cited

U.S. PATENT DOCUMENTS

| | | | |
|---|---|---|---|
| 427,641 | 5/1890 | Tucker | 190/55 R |
| 884,787 | 4/1908 | Woolfenden | 190/55 R |
| 1,448,707 | 3/1923 | Pidlyski | 70/70 |

FOREIGN PATENT DOCUMENTS

| | | | |
|---|---|---|---|
| 202911 | 10/1908 | Fed. Rep. of Germany | 190/55 R |
| 366593 | 1/1923 | Fed. Rep. of Germany | 70/70 |

*Primary Examiner*—Robert L. Wolfe
*Attorney, Agent, or Firm*—Natter & Natter

[57] ABSTRACT

A keyless latch lock mechanism for ansate luggage such as an attache case. The mechanism includes a spring biased slide bolt attached at one end to a handle, the distal end being provided with a tail latch registrable with a latch keeper for fastening respective luggage closure members. A retainer element is resiliently urged into socketed engagement within the slide bolt to immobilize the bolt in a locked mode. The retainer element is selectively retractable from the socket when a cooperating index disc is rotated to a preselected setting. The handle is also functional for applying a displacement force to the bolt.

In a variant embodiment, the displacement force is applied by a cam actuated by the handle.

12 Claims, 10 Drawing Figures

FIG. 1
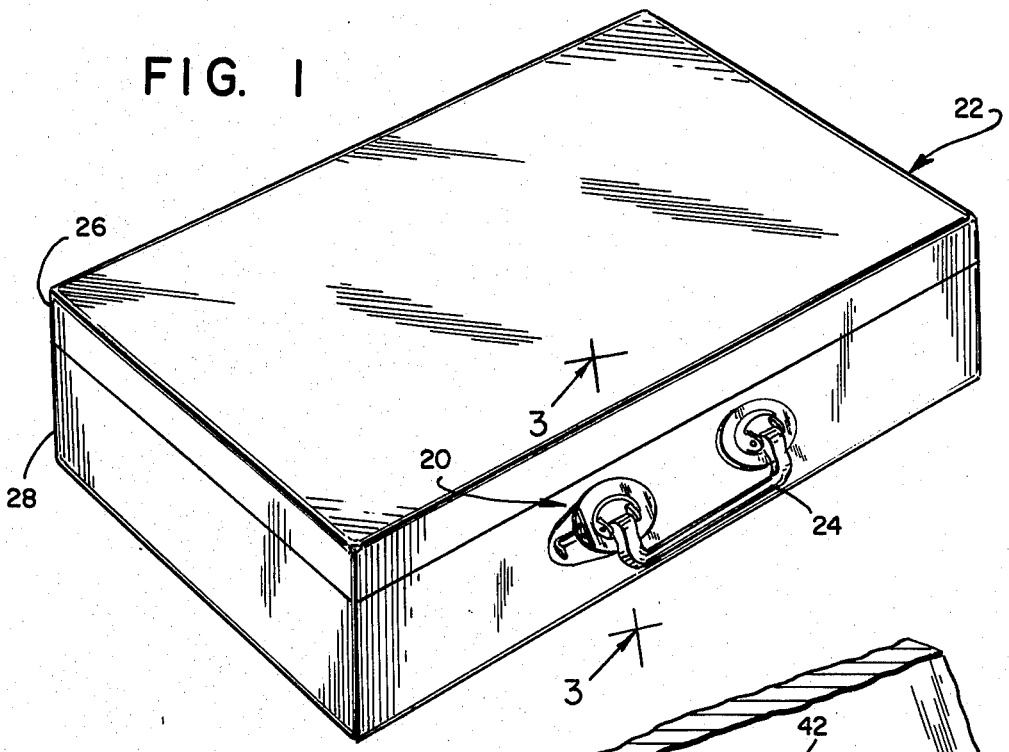
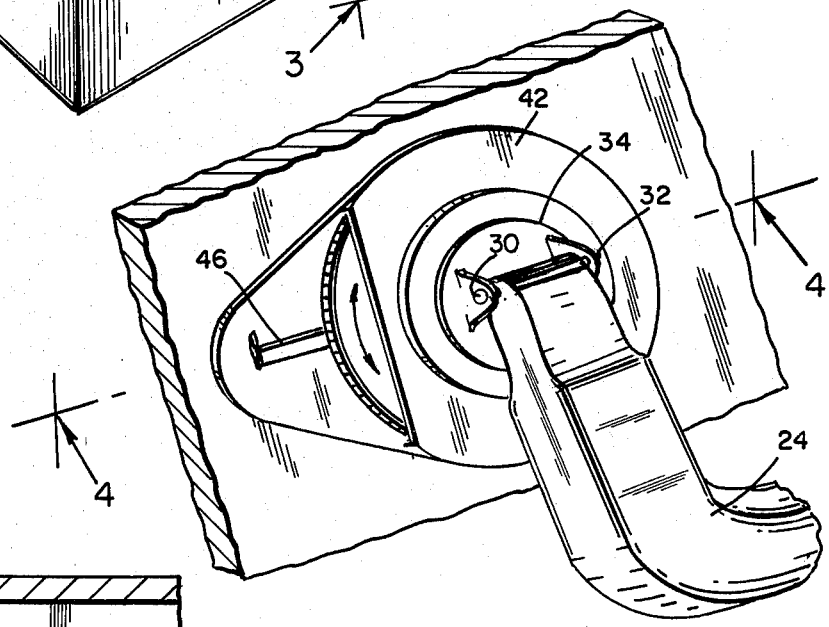
FIG. 2
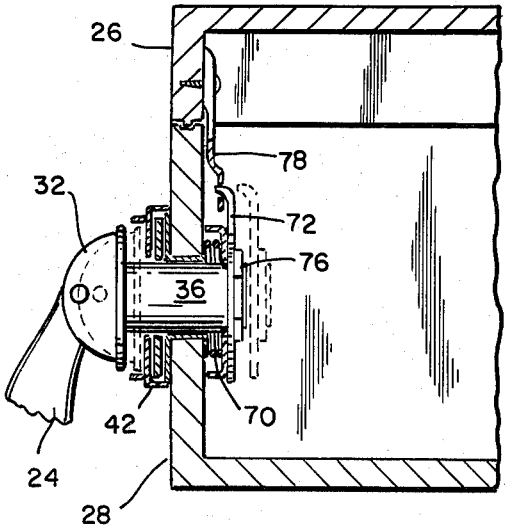
FIG. 3

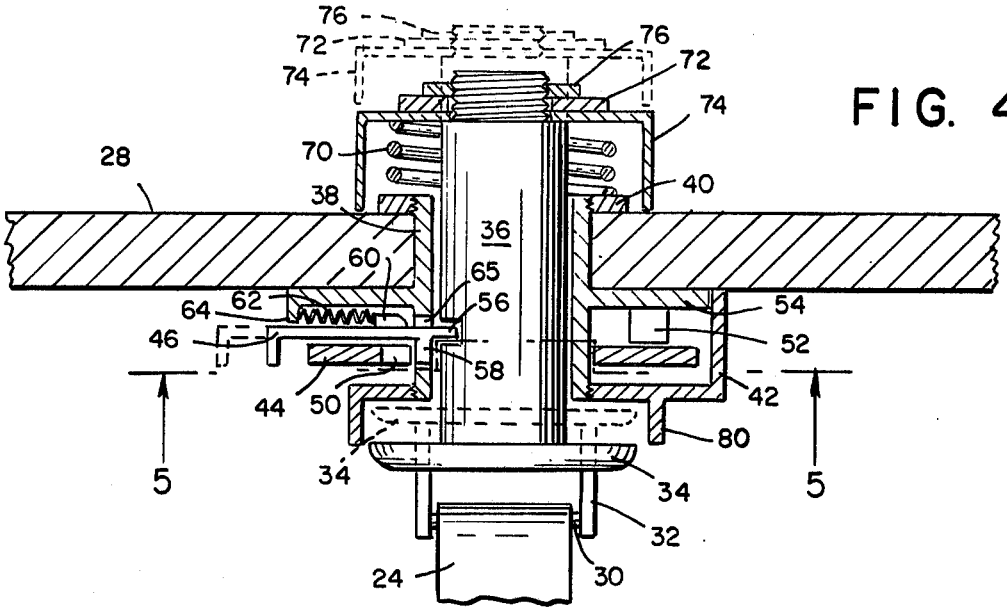
FIG. 4
FIG. 5
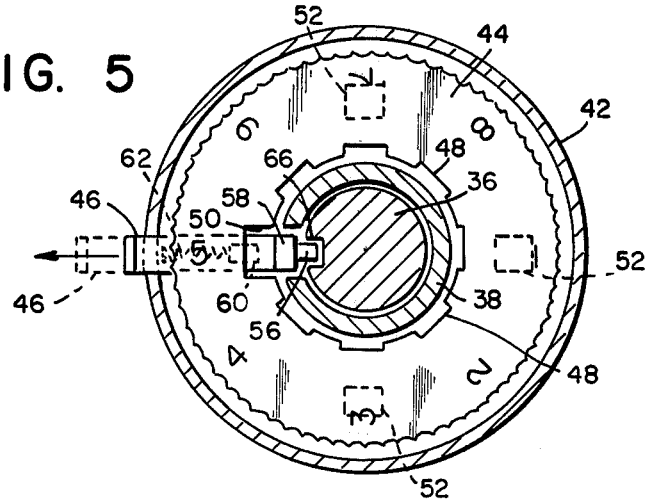
FIG. 10
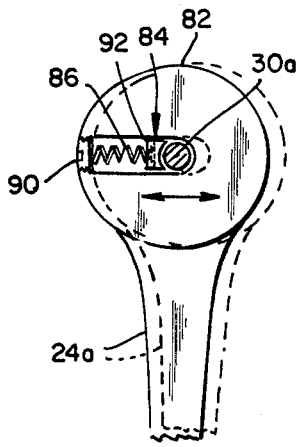
FIG. 6
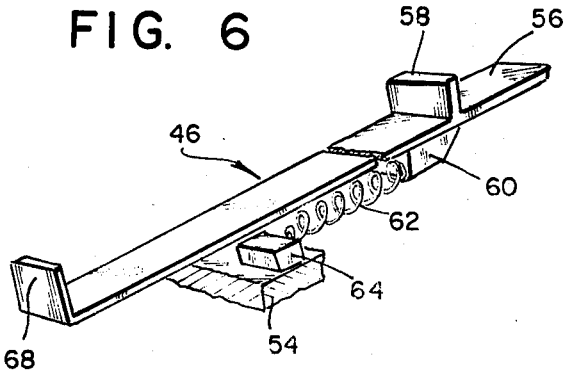

FIG. 9
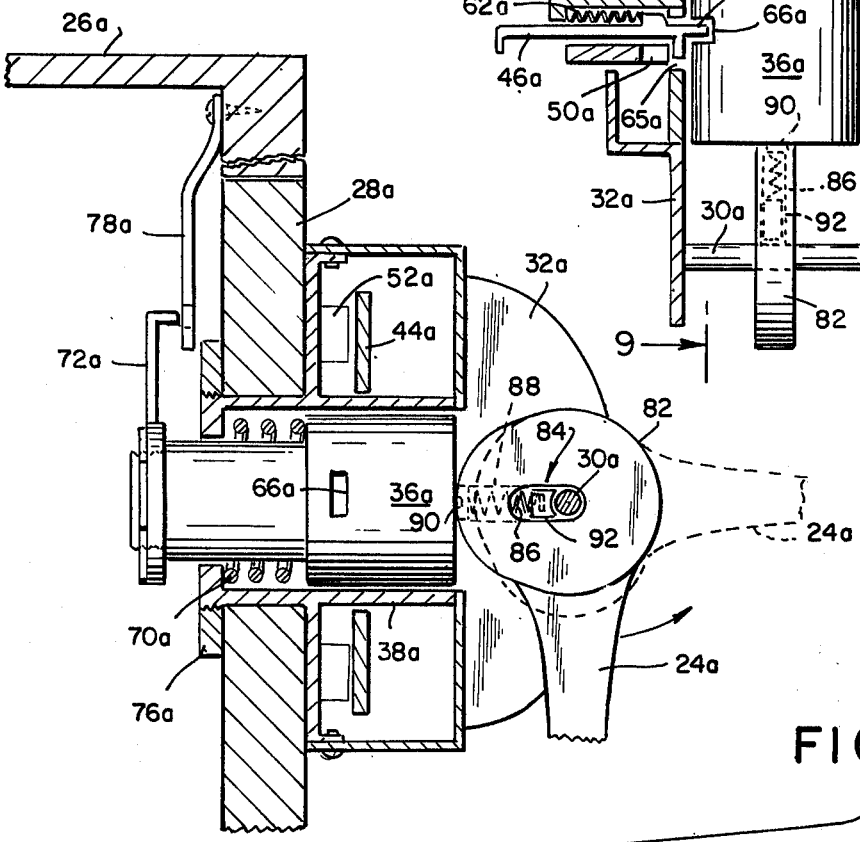
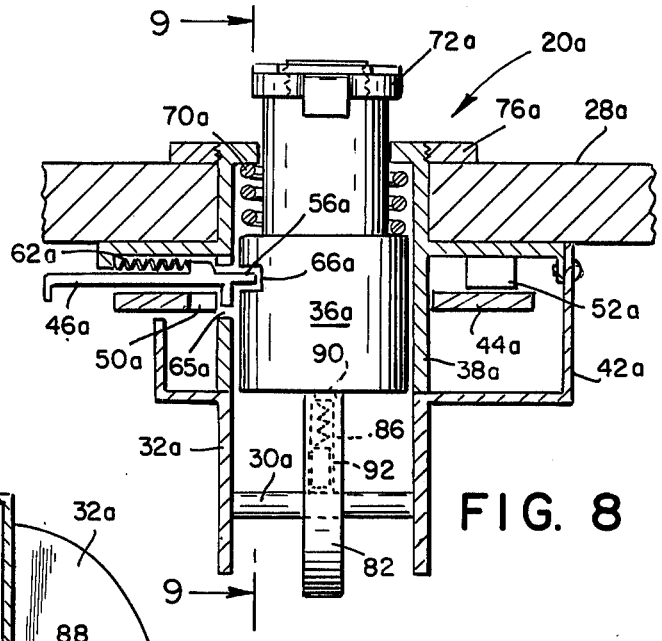
FIG. 8
FIG. 7
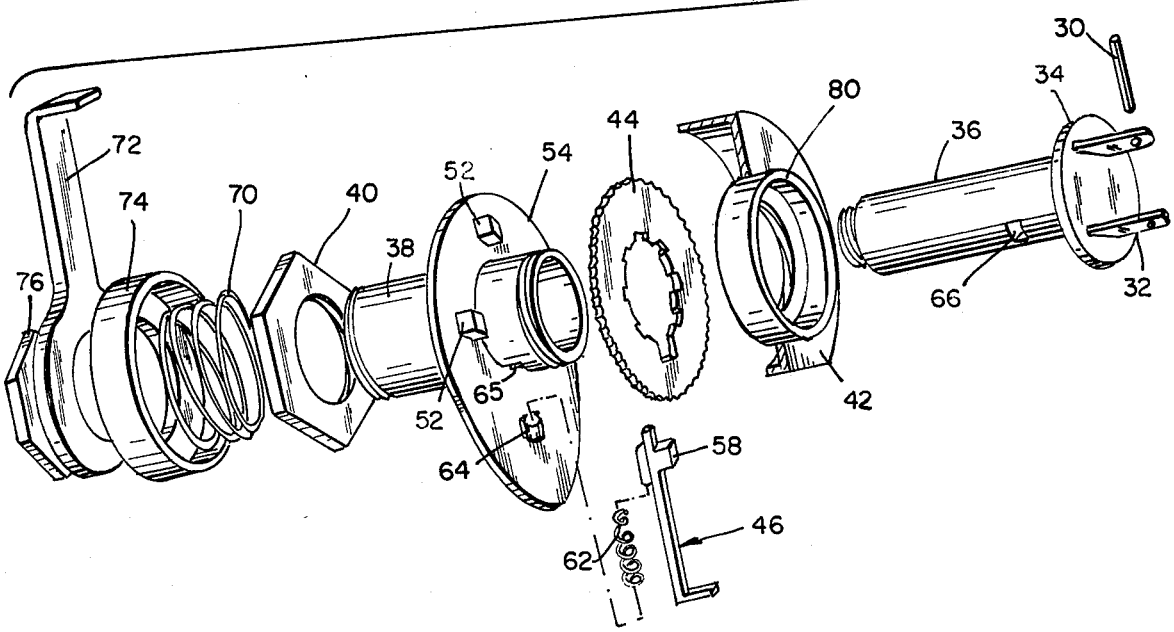

LATCH LOCK MECHANISM FOR ANSATE LUGGAGE

BACKGROUND OF THE INVENTION

1. Field of the Invention

This invention relates generally to latch mechanisms and especially to an improved latch lock arrangement.

In particular, the device of this invention is concerned with a keyless latch lock combined with a handle assembly and adaptable for use with an attache case or similar article.

2. Description of the Prior Art

The latch lock mechanism of this invention is designed for security purposes and to protect attache cases, articles of luggage, and similar containers so as to deter unauthorized removal of the contents therein. The device also provides for facilitated latching of the case to insure that the case is secured whenever lifted by the handle.

Although the use of locking devices for attache cases and analogous containers is common in the prior art, in many instance these prior devices had distinct shortcomings or otherwise were found deficient.

For example, attache cases of the prior art frequently used an externally mounted spring loaded hinge latch and lock mechanism. The resultant latch hardware was thus exposed to the elements, and frequently moisture and foreign matter adversely affected the operation and useful life span. Furthermore, independent latches were used primarily for sealing the case, and separate lock devices were installed for security purposes. In contrast, the latch lock mechanism of this invention incorporates a latch and locking mechanism which is combined with the handle assembly. In addition, the latch arrangement is substantially concealed and thus protected from environmental conditions. Furthermore, the elimination of external latches presents a nonobtrusive appearance to the case.

Locking apparatus of the prior art which were combined with handle assemblies, such as that shown in U.S. Pat. No. 427,641, were mounted exteriorly of the case and consequently did not have the advantages of the concealed latch mechanism as in this invention. Another device utilizing an enclosed latch lock was disclosed in U.S. Pat. No. 2,416,497. This arrangement, however, used pivotal hooks for engaging a bridge bearing member which extended across the container opening and presented an obstacle which interfered with access and was a distinct disadvantage. Furthermore, the lock described did not provide for keyless operation and required rotation of the circular latch by a key for releasing the hooks. In the instant invention, as will be noted, the lock arrangement encompasses an index disc and bolt retainer for keyless operation.

A varient of the preferred embodiment utilizes a purchase in the form of a cam which is actuated by the swingable handle placement. A previously patented lock shown in U.S. Pat. No. 884,787 described a cam operated lock, however this device did not incorporate a stress relief pivotal mounting for the cam and automatic bolt locking.

It should thus be apparent that this improved latch lock mechanism overcomes many of the problems and disadvantages of the prior art and provides a practical solution to a latch lock device for securing ansate luggage.

SUMMARY OF THE INVENTION

Briefly, the invention concerns an improved latch lock for an attache case or similar baggage. The purpose of this device is to provide an integrated latch and lock combined with a handle assembly for the case. The mechanism is further designed to secure a complementary cover and base closure member and to insure latching engagement whenever the closed case is lifted by the handle.

Basically, the apparatus of the instant invention includes a slide bolt extending through the base member. A tail latch is mounted to the slide bolt and is adapted for engagement with a registered latch keeper affixed to the cover member. When the slide bolt is displaced by the handle a retainer element is resiliently urged into socketed engagement to selectively immobilize the bolt in a locked mode. The retainer element is retractable by the cooperative interaction of a rotatable index disc to release the slide bolt. The slide bolt is spring loaded so that, when released, the tail latch will disengage from the latch keeper.

In an alternate form of the invention the slide bolt is biased for engaging a tail latch with a latch keeper. The handle assembly includes a cam arrangement wherein a slide bolt displacement force for disengaging the tail latch is exerted by swingable displacement of the handle to a horizontal resting position against the case.

It should be apparent that the latch lock of this invention achieves a latching and keyless lock arrangement for securing an attache case or similar container so as to prevent unauthorized access.

Another feature of this invention concerns the internal mounting of the slide bolt and latching elements which provide for efficient and reliable operation.

A further advantage of this latch hook system is that it provides self-locking engagement of the slide bolt.

Having thus summarized the invention, it will be seen that an object thereof is to provide a latch lock mechanism for ansate luggage of the general character described herein.

Specifically, it is an object of this invention to provide an integrated latch and lock mechanism combined with a handle assembly and adapted for use on an attache case.

An additional object of this invention is to provide a latch lock mechanism including an index disc for keyless operation.

Still another object of this invention is to provide a latch lock mechanism wherein the latching elements are internally mounted and substantially concealed from view.

Another object of this invention is to provide a latch-lock mechanism having a slide bolt which is automatically engageable to lock the case when lifted by the handle.

Yet another object of this invention is to provide a latch lock mechanism wherein the handle is used for actuating the slide bolt.

A still further object of this invention is to provide a latch lock mechanism which is economical to manufacture and operationally reliable.

The foregoing and other objects, features and advantages of this invention will become more apparent from the following detailed specification and illustrative embodiments which may be achieved by the particular arrangements depicted in and described in conjunction with the accompanying drawings.

DETAILED DESCRIPTION OF THE DRAWINGS

In the accompanying drawings in which are shown the preferred embodiments of this invention:

FIG. 1 is a perspective view of an attache case and includes a latch lock mechanism as embodied by the present invention;

FIG. 2 is a fragmentary perspective view to an enlarged scale of a handle assembly as depicted in FIG. 1 and shows an index disc and bolt retainer element;

FIG. 3 is a sectional view to a slightly enlarged scale taken substantially along line 3—3 of FIG. 1 and shows the latch lock mechanism in the locked position with a tail latch engaging a latch keeper; the broken line portion illustrates the alternate unlocked position of the mechanism;

FIG. 4 is a sectional view taken substantially along line 4—4 of FIG. 2 and illustrates the arrangement of a slide bolt engaged by a bolt retainer element and further shows a bearing cap for supporting the case when being handle held; the alternate unlocked position of the bolt is shown in the broken line portion;

FIG. 5 is a sectional view taken substantially along line 5—5 of FIG. 4 and shows in detail an index disc with the bolt retainer element, the retracted position of the retainer element being shown in broken line;

FIG. 6 is an isolated perspective view to an enlarged scale and shows the bolt retainer element and a retainer spring for biasing the retainer element toward the slide bolt;

FIG. 7 is an exploded perspective view of the latch lock mechanism and shows the interrelationship of the elements as assembled;

FIG. 8 is a sectional view of a modified embodiment of the present invention wherein the handle assembly includes a cam member for exerting an unlocking force upon the slide bolt;

FIG. 9 is a sectional view of the modified embodiment taken substantially along line 9—9 of FIG. 8 and shows the slide bolt displaced by the cam to release a tail latch from a latch keeper as the handle is swung to a nonoperative horizontal position as indicated by the arrow and broken lines; and FIG. 10 is an isolated view of a portion of the cam member showing a stress relief pivotal mounting wherein the cam member is displaced to the position shown by the broken line when a camming action is applied upon the slidable bolt prior to retraction of the bolt retainer element.

DETAILED DESCRIPTION OF THE INVENTION

Referring now in detail to the drawings and specifically to FIG. 1, a latch lock mechanism in accordance with this invention is denoted generally by reference numeral 20.

The latch lock mechanism 20 is shown as being typically incorporated in an attache case 22 and combined with a handle 24. The invention will be described in conjunction with the attache case 22, however it should be noted that the latch lock mechanism 20 can equally be utilized in other forms of analogous luggage. Furthermore, although reference will be made throughout to a single latch lock 20, it is contemplated that the handle 24 can include a similar latch lock 20 at each terminal mounting to the attache case 22.

The attache case 22 is in all other respects of conventional construction and includes hinged closure members such as a cover member 26 and a base member 28. The latch lock mechanism 20 is substantially concealed from view and does not require exteriorly mounted clasps, hinges, snaps or other hardware.

The handle 24, as shown in FIG. 2, is swingably secured to the case 22 by a pivot pin 30 extending through a mounting bracket 32. The mounting bracket 32 includes a circular base plate 34 which is affixed to a slide bolt 36. As noted in FIG. 4, the slide bolt 36 is contained within a lock cylinder 38 which extends through the wall of base member 28. The lock cylinder 38 is further provided with an externally threaded portion at both ends and is fastened in place by a respective lock nut 40 and a threaded segment of a lock housing 42. The lock housing 42 encloses an index disc 44 and a bolt retainer element 46. As best shown in FIGS. 5 and 7, the index disc 44 is centrally apertured for rotational displacement around the slide bolt 36. A plurality of notches 48 are formed along the inner periphery of the aperture including a keyway 50, the purpose of which will be further described hereinafter. The index disc 44 is supported on guides 52 projecting from a mounting plate 54. The plate 54, in turn, is secured to the base member 28.

The bolt retainer element 46, as illustrated in FIGS. 6 and 7, includes a tongue portion 56, a shoulder portion 58 and a dependent projection 60. A retainer spring 62 positioned between a spring abutment 64 on the mounting plate 54 and the dependent projection 60 to resiliently urge the retainer 46 toward the bolt 36. The lock cylinder 38 is provided with an access opening 65 which is aligned with a socket 66 formed within the bolt 36. The tongue 56 will thus be accommodatingly received within the socket 66 to immobilize the bolt 36 in a locked mode.

In order to release the bolt 36 the tongue 56 must be withdrawn from the socket 66. This is accomplished by positioning the index disc 44 to a preselected setting. For this purpose, the outer periphery of the disc is knurled to provide a frictional surface. In addition, the index disc 44 is provided with appropriate locating indicia typically shown as numerals "1" through "8". It should be noted that the lock housing 42 envelops the disc 44 and that only a portion of the indicia is visible to the user as viewed in FIG. 2.

In order to withdraw tongue 56, the keyway 50 must be aligned with the shoulder portion 58 by rotating the index disc 44 in either direction as indicated by arrows using the indicia markings thereon as a guide. The retainer element 46 can be retracted, as by using a thumb piece 68 provided thereon, and thus pulled outwardly and against the force of spring 62. The shoulder portion 58 will seat within the keyway 50 to thus permit withdrawal of the tongue 56. The notches 48 are of insufficient depth to permit full seating of the shoulder portion 58 and serve merely as a preventive measure to obfuscate the unauthorized locating of keyway 50 such as by applying pull-out pressure to the retainer 46 while rotating the index disc 44.

Considering now the opposite end of slide bolt 36, a helical coil spring 70 surrounds the slide bolt 36 for biasing the bolt 36 to an inwardly (unlocked) position as illustrated by the broken lines in FIG. 4. A reduced diameter threaded shank receives a tail latch 72 and a bearing cap 74 which is secured by a fastening nut 76.

The latching operation will be described with reference being made particularly to FIGS. 3 and 4. A latch keeper 78 is secured to the cover member 26 and is adapted to receive tail latch 72. The tail latch 72 will engage the latch keeper 78 when the slide bolt 36 has been displaced to a locked position as shown in FIG. 4 by the solid lines. This is accomplished by applying an outwardly directed locking force upon the handle 24. The tongue 56 on the retainer element 46 will then automatically enter the socket 66 to thus immobilize the bolt 36. The locking force can also be applied by the weight of the case 22 especially when it is carried by the handle 24. In this connection, it should be noted that the weight of the carrying case 22, when held by handle 24, will be supported by the bearing cap 74 which acts against the inner surface of the base member 28. In addition, a collar 80 has been provided as part of the lock housing 42 and surrounds the base plate 34 to shield the projected portion of the slide bolt 36 when in the locked mode. After the tongue 56 has engaged the socket 66, the index disc 44 can be turned so that the keyway 50 is no longer aligned with the shoulder portion 58. It should be apparent that the carrying case 22 cannot be opened until the index disc 44 has been appropriately reset and the retainer element 46 has been retracted. The tail latch 72 will then self-designate from the latch keeper 78 as a result of the biasing force exerted by the spring 70.

An alternate embodiment, as shown in FIGS. 8, 9, and 10, will now be described wherein the same reference numerals have been used for correspondingly similar parts with the added suffix letter "a".

A latch lock mechanism **20*a* is a modified form of the invention and utilizes a substantially identical lock arrangement. Specifically, a slide bolt 36*a* is mounted within a lock cylinder 38*a*. A bolt retainer element 46*a* is resiliently urged by a retainer spring 62*a* toward the bolt 36*a* such that a tongue 56*a* will automatically enter a socket 66*a* to immobilize the bolt 36*a*. The bolt retainer element 46*a* is selectively retractable when a cooperating index disc 44*a* is rotated to a preselected setting and will operate in the manner described with reference to the previous embodiment for releasing the bolt 36*a*** from a locked mode.

It should be noted, however, that a helical spring **70*a* surrounding the bolt 36*a* is mounted within the lock cylinder 38*a* and will thus urge a tail latch 72*a* into engagement with a latch keeper 78*a*. The slide bolt 36*a* must now be displaced inwardly in opposition to the spring force in order to release the tail latch 72*a***.

The inwardly directed unlocking force is applied to the slide bolt **36*a* by means of a cam 82 attached to a handle 24*a*. The cam 82 is mounted on a pivot pin 30*a* extending from a mounting bracket 32*a***.

The mechanical advantage achieved through the use of cam 82 can be provided using other purchase devices.

The cam 82 is pivotally mounted on pin **30*a* and for that purpose is provided with a slotted opening 84. A cam spring 86 is captively located within a transverse bore 88 by a set screw 90 and has a pin cradle 92 for applying a compressive force to yieldably position the pivot pin 30*a* in the slotted opening 84**.

It should be apparent that when the handle **24*a* is swung to a horizontal resting position on either side of the carrying case 22*a* the cam 82 will actuate the slide bolt 36*a* and displace same in opposition to the force exerted by helical spring 70*a* to thus release tail latch 72*a* from a latch keeper 78*a* as illustrated in FIG. 9. When the handle 24*a* has been swung prior to the retraction of the retainer element 46*a*, the cam 82 will be displaced in the slotted opening 84 and will assume an alternate position shown by the broken lines in FIG. 10. The slotted opening 84, together with cam spring 86, provides a safety feature to relieve stress on the retainer element 46*a* and will prevent "forced" opening of the lock. When the handle 24*a* is placed in an upright vertical position, the slide bolt 36*a* will automatically be displaced and the tail latch 72*a* will engage the latch keeper 78*a* as shown by the broken line illustration of FIG. 9. In addition, the tongue 56*a* will enter the socket 66*a*. The weight of the carrying case 22 will be supported by the tail latch 72*a* abutment with a lock nut 76*a* which secures the lock cylinder 38*a***.

The above cited embodiments are intended as exemplary and, while they have described the invention with specific implementation thereof, other modifications and changes might be made in these embodiments as set forth and will be apparent to those skilled in the art. It should therefore be understood that all material shown and described in the accompanying drawings is to be interpreted as illustrative and not in a limiting sense and the invention should be considered as comprehensive of all of the same which come within the scope of the appended claims.

Having thus described the invention, there is claimed as new and desired to be protected by Letters Patent:

1. A keyless latch lock mechanism for an attache case having at least two closure members and comprising a spring urged slide bolt extending into one of said closure members, a tail latch mounted to the slide bolt for movement therewith, a latch keeper mounted to the other of said closure members and registrable with the tail latch for fastening the closure members, handle means for carrying the case further providing selective reciprocal displacement of the said slide bolt to respectively engage and disengage the tail latch, locking means for securing the slide bolt in a locked mode and cooperative indexing means for releasing the slide bolt.

2. A latch lock mechanism as claimed in claim 1 wherein the locking means further includes a retainer element and biasing means for resiliently urging the retainer element toward the slide bolt for automatic engagement therewith.

3. A latch lock mechanism as claimed in claim 2 wherein the indexing means includes an index disc surrounding the slide bolt exteriorly of the case and being rotationally displaceable to a preselected position for retracting the retainer element.

4. A latch lock mechanism as claimed in claim 3 wherein the index disc further includes a central aperture, said aperture being provided with a keyway, a shoulder portion provided on the retainer element, said shoulder portion being adapted for accommodation within the keyway whereby the retainer element is retractable from engagement with the slide bolt when the shoulder is aligned with the keyway.

5. A latch lock mechanism as claimed in claim 4 wherein the slide bolt is provided with a socket, said retainer element being provided with a tongue for insertion into the socket during engagement with the slide bolt.

6. A latch lock mechanism as claimed in claim 4 wherein the central aperture is provided with a plurality of peripheral notches, said notches being of insufficient depth to fully seat the retainer shoulder and being effective to deter the unauthorized location of the keyway.

7. A latch lock mechanism as claimed in claim 5 further including bearing means secured to the slide bolt for supporting the weight of the case.

8. A latch lock mechanism as claimed in claim 3 further including spring means for biasing the slide bolt interiorly into the case for disengagement of the tail latch.

9. A latch lock mechanism as claimed in claim 3 further including means biasing the slide bolt exteriorly from the case to engage the tail latch with the latch keeper.

10. A latch lock mechanism as claimed in claim 9 wherein the handle includes purchase means for applying a displacement force to the slide bolt to release the tail latch.

11. A latch lock mechanism as claimed in claim 10 wherein the purchase means includes a cam element, said cam element providing a displacement force to the slide bolt when the handle is swung to a horizontal position adjacent the case.

12. A latch lock mechanism as claimed in claim 10 wherein the cam element includes pressure release means for displacing the cam when the handle is swung prior to retraction of the retainer element from engagement with the slide bolt.

* * * * *